United States Patent [19]

Steiner

[11] 4,360,711

[45] Nov. 23, 1982

[54] MAGNETIC ELECTRO-ACOUSTIC TRANSDUCER CONSTRUCTION

[75] Inventor: Frederick Steiner, Stapleford, England

[73] Assignee: Plessey Overseas Limited, Illford, England

[21] Appl. No.: 198,652

[22] Filed: Oct. 20, 1980

[30] Foreign Application Priority Data

Oct. 20, 1979 [GB] United Kingdom ..... 7936508

[51] Int. Cl.[3] ..... H04R 11/00; H04R 31/00

[52] U.S. Cl. ..... 179/115 R

[58] Field of Search ..... 179/114 R, 115 R, 117, 179/120; 29/594

[56] References Cited

U.S. PATENT DOCUMENTS

| | | | |
|---|---|---|---|
| 2,902,668 | 9/1959 | Savit | 179/115 R |
| 3,497,638 | 2/1970 | Cohen | 179/115 R |
| 4,205,205 | 5/1980 | Babb | 179/115.5 R |

*Primary Examiner*—George G. Stellar

*Attorney, Agent, or Firm*—Fleit & Jacobson

[57] ABSTRACT

A method of making an acoustic transducer for telephones consists of securing the magnet assembly and the armature supporting ring inside the plastic casing of the transducer and then surrounding or partly surrounding these with a thermosetting resin such as epoxy resin, poured inside the casing.

The core, the armature supporting ring and the outer edge of the casing are then machined with reference to the magnet face to the required very small tolerances, the cured resin holding the parts securely during the machining operations.

22 Claims, 7 Drawing Figures

MAGNETIC ELECTRO-ACOUSTIC TRANSDUCER CONSTRUCTION

Figure 1:
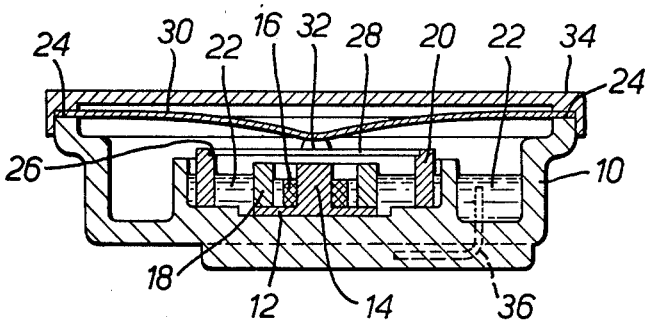

This invention relates to electro-acoustic transducers especially to those adapted to be used as telephone receivers or microphones. The invention also relates to an improved method of manufacturing such electro-acoustic transducers.

It is desirable that telephone receivers and microphones are small, inherently sturdy, contain a small number of parts and be inexpensive to manufacture. In order to ensure that the efficiency of such a transducer is the optimum obtainable it is most important that the space within the transducer is used to the utmost advantage.

It is also important that the number of joints in the magnetic circuit of the transducer are reduced to a minimum, and that the dimension of gaps in the magnetic circuit are accurately determined and fixed during manufacture.

It is an object of the present invention therefore, to provide an electro-acoustic transducer which will meet or substantially meet these requirements.

According to the present invention an electro-acoustic transducer comprises a walled housing, a stemmed pole piece mounted on the base of the housing having a stem projecting perpendicularly from a plate, a coil wound on the stem, at least one magnet mounted on the plate of the stemmed pole piece arranged to surround or substantially surround the coil, a non magnetic armature supporting member formed or mounted on the base of the housing spaced from and surrounding the at least one magnet and a flexible armature supported on the supporting member, the stemmed pole piece, the coil, the at least one magnet and the supporting member being located in spaced relationship on the base of the housing by a thermo-setting resin, the stemmed pole piece, the supporting member and the walls of the housing being machined after curing of the resin whereby the armature is supported on the supporting member with a predetermined space between the armature and the stemmed pole piece.

Preferably, the armature has the central portion of a diaphragm supported thereon, the outer edges of the diaphragm being supported by the walls of the housing. The walled housing may be formed in a plastics material. The non magnetic armature supporting member is preferably aluminium, but may be any suitable non-magnetic material such as plastic. It may also be formed integrally with the plastic walled housing. Preferably it is a ring.

Preferably, the at least one magnet comprises an annular shaped magnet and preferably the ring, the annular magnet and the coil are arranged concentrically in the housing.

The thermo-setting resin is preferably an epoxy resin. The flexible armature preferably comprises a circular ferrous metal plate having at least one slot to provide the required degree of flexibility. The slot is preferably substantially circumferential and extends part way around the centre of the armature. Preferably several slots are formed spaced radially from each other. The diaphragm is preferably substantially conical in shape and preferably is formed in thin aluminium alloy. Alternatively the diaphragm may be formed in plastics material or paper having the combined requirements of strength lightness and elasticity. The central portion of the diaphragm is preferably secured to the central portion of the armature by a suitable adhesive. The shape of the diaphragm preferably conforms to the outer shape of the walled housing and the outer edges of the diaphragm are preferably secured to the walls of the housing by a suitable cover which clamps the edges of the diaphragm to the tops of the walls.

The invention also comprises a method of manufacturing an electro-acoustic transducer comprising the steps of winding a coil on the stem of a stemmed pole piece, the stem projecting perpendicularly from a plate, mounting an at least one magnet on the plate so as to surround or substantially surround the coil, locating this assembly within a walled housing within a non magnetic armature supporting member formed or located on the base of the walled housing so as to be spaced from and surrounded by the armature supporting member, inserting a quantity of thermo-setting resin into the walled housing and allowing to cure to retain the parts in their respective positions and machining the end of the stem, the top surface of the armature supporting member and the top surfaces of the walls of the housing to predetermined levels in relation to the top surface of the at least one magnet.

Figure 2A:
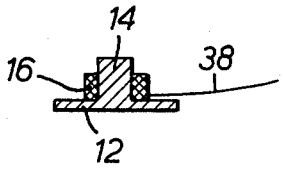
Figure 2B:
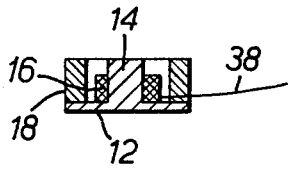
Figure 2C:
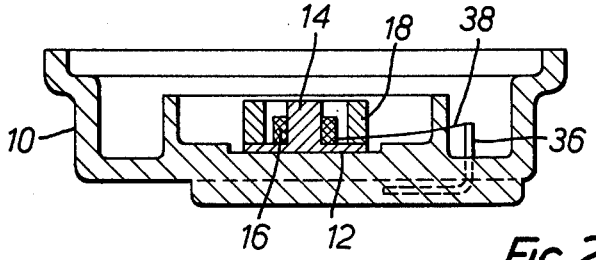
Figure 2D:
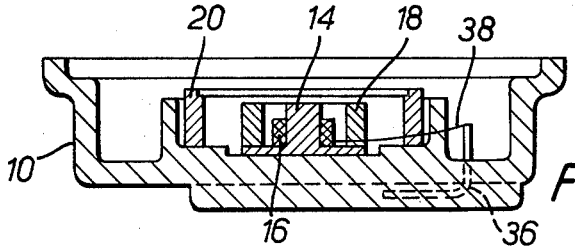
Figure 2E:
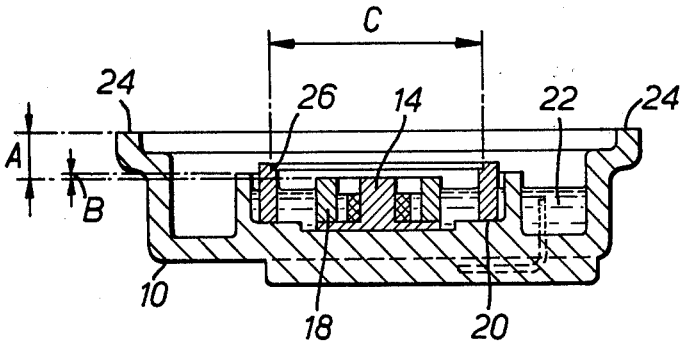
Figure 3:
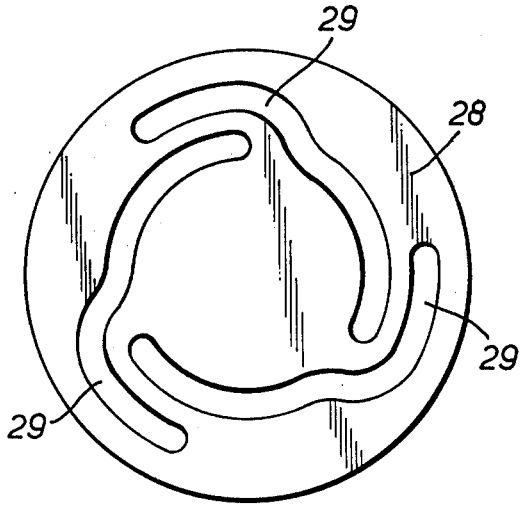

An embodiment of the invention will now be described by way of example only with reference to the accompanying drawings in which FIG. 1 is a cross-sectional view of an electro-acoustic transducer in accordance with the invention, FIGS. 2*a* to 2*e* illustrate in cross-section the steps employed in manufacturing the transducer in accordance with the invention, and FIG. 3 is a plan view of the armature used in the transducer.

FIG. 1 illustrates an electro-acoustic transducer intended to be used as a telephone receiver or a microphone, two such transducers being mounted in the handset of a telephone.

Each transducer consists of a plastic body 10 in which is located a stemmed pole piece consisting of a plate 12 and a cylindrical stem 14. Around the stem 14 is wound a coil 16, suitably insulated from the plate 12 and the stem 14, and mounted on the plate 12 to concentrically surround the coil 16 and the stem 14 is an annular magnet 18 having accurately ground ends. Concentrically mounted around the magnet 18 is a non-metallic ring 20 which may be aluminium or plastic or may be formed as an integral part of the body 10. The body can be provided with suitable projections to locate these parts in their correct positions but the parts are permanently secured in the body with a suitable thermosetting resin such as an epoxy resin 22 which is poured into the body 10 after location of the ring 20.

The ring 20, the stem 14 and the upper edges 24 of the body 10 are now accurately machined to the required dimensions with reference to the upper surface of the accurately ground magnet 18.

A step 26 is formed at this time in the ring 20 to form a seating for and locate a circular ferrous metal flexible armature 28. To give the desired flexibility to the armature 28 several grooves 29 are formed in the armature extending substantially circumferentially around part of the armature. Certain portions of the grooves 29 are apaced radially from each other (see FIG. 3).

A substantially conical diaphragm 30 is secured to the central portion of the armature, with a suitable adhesive 32, and the outer edges of the diaphragm are adapted to be clamped on to the upper edges 24 of the body 10 by means of a perforated cover 34. The cover can be secured in position by an adhesive or swaged on to the body 10.

The body 10 can be circular in shape, part-circular or substantially rectangular, the diaphragm being shaped to conform with the shape of the body.

The diaphragm may be formed from thin aluminium alloy sheet, but alternatively may be formed in a plastic material or even paper providing it has the combined requirements of strength lightness and elasticity. The coil is connected by wires to terminals 36 (shown in broken lines in FIG. 1), this area also being filled with an epoxy resin. Suitable channels or holes are formed in the magnet 18 the ring 20 and/or various parts of the body to enable the wires to reach the terminals 36.

The magnet 18 may be a single annular magnet as described or may consist of two or more parts. Similarly the magnet or magnets may not be annular and the ring 20 may not be annular, but any suitable shape to support the armature 28 and retain the required tolerances between the magnet and the armature and the magnet and the upper edges of the body 10.

FIGS. 2*a* to 2*e* illustrate the steps taken in the manufacture of the transducer.

Firstly, (FIG. 2*a*) the coil 16 is wound on the stem 14 of the stemmed pole piece and the annular magnet 18 is then mounted on the plate 12, spaced from the coil and concentrically with the stem 14 (FIG. 2*b*) This assembly is located inside the body 10, the coil wires 38 connected to the terminals 36 and the coil checked (FIG. 2*c*). The ring 20 is now located in the body concentrically with the magnet 18 and the stem 14 (if the ring is a separate part to the body), (FIG. 2*d*) and the body is filled to a predetermined level with an epoxy resin.

When the resin cures and has hardened sufficiently to hold the parts securely in position the top of the stem 14 is machined to the same level as the upper surface of the magnet 18. The armature seating 26 in the ring 20 is machined to a dimension B above the upper surface of the magnet 18 which typically is 0.0068 to 0.0077 inches. At the same time a step is formed by machining the ring 20 to a diameter C for locating the armature. The upper edges 24 of the body are also machined to a distance A above the upper surface of the magnet 18 which typically is 0.146 to 0.148 inches (FIG. 2*e*). The armature 28 is located in position, an amount of adhesive 32 added to the centre of the armature and the diaphragm 30 fitted in position. Finally, the cover 34 is secured in position and swaged on to the body 10.

What I claim is:

1. An electro-acoustic transducer comprising a walled housing, a stemmed pole piece mounted on the base of the housing having a stem projecting perpendicularly from a plate, a coil wound on the stem, at least one magnet mounted on the plate of the stemmed pole piece arranged to at least substantially surround the coil, a non-magnetic armature supporting member situated on the base of the housing spaced from and surrounding the at least one magnet and a flexible armature supported on the supporting member, the stemmed pole piece, the coil and the at least one magnet being located in spaced relationship on the base of the housing by a thermo-setting resin, the stemmed pole piece, the supporting member and the walls of the housing being machined after curing of the resin whereby the armature is supported on the supporting member with a predetermined space between the armature and the stemmed pole piece.

2. An electro-acoustic transducer as claimed in claim 1 wherein the supporting member is located in spaced relationship on the base of the housing by the thermo-setting resin.

3. An electro-acoustic transducer as claimed in claim 1 or 2 in which the walled housing is formed in a plastic material.

4. An electro-acoustic transducer as claimed in claim 1 or 2 in which the non-magnetic armature supporting member is formed of aluminium alloy.

5. An electro-acoustic transducer as claimed in claim 1 or 2 in which the non-magnetic armature supporting member is formed of plastic.

6. An electro-acoustic transducer as claimed in claim 3 in which the non-magnetic armature supporting member is formed integrally with the plastic walled housing.

7. An electro-acoustic transducer as claimed in any preceding claim 1 or 2 in which the non-magnetic armature supporting member is a ring.

8. An electro-acoustic transducer as claimed in claim 1 or 2 in which the at least one magnet comprises an annular shaped magnet.

9. An electro-acoustic transducer as claimed in claim 1 or 2 in which the non-magnetic armature supporting member is a ring, and in which the at least one magnet comprises an annular shaped magnet, and in which the ring, the annular magnet and the coil are arranged concentrically in the housing.

10. An electro-acoustic transducer as claimed in claim 1 or 2 in which the thermo-setting resin is an epoxy resin.

11. an electro-acoustic transducer as claimed in claim 1 or 2 in which the flexible armature comprises a circular ferrous metal plate having at least one slot to provide the required degree of flexibility.

12. An electro-acoustic transducer as claimed in claim 11 in which the slot is substantially circumferential and extends part way around the centre of the armature.

13. An electro-acoustic transducer as claimed in claim 12 in which several slots are formed spaced radially from each other.

14. An electro-acoustic transducer as claimed in claim 1 or 2 in which the armature has the central portion of a diaphragm supported thereon, the outer edges of the diaphragm being supported by the walls of the housing.

15. An electro-acoustic transducer as claimed in claim 14 in which the diaphragm is formed in plastic material.

16. An electro-acoustic transducer as claimed in claim 14 in which the diaphragm is formed of paper.

17. An electro-acoustic transducer as claimed in claim 14 in which the central portion of the diaphragm is secured to the central portion of the armature by a suitable adhesive.

18. An electro-acoustic transducer as claimed in claim 17 in which the adhesive is silicon elastomer.

19. An electro-acoustic transducer as claimed in claim 14 in which the diaphragm conforms to the outer shape of the walled housing and the outer edges of the diaphragm are secured to the walls of the housing.

20. An electro-acoustic transducer as claimed in claim 19 in which the outer edges of the diaphragm are secured to the walls of the housing by a suitable cover which clamps the edges of the diaphragm to the tops of the walls.

21. An electro-acoustic transducer as claimed in claim 14 in which the diaphragm is substantially conical in shape and is formed in thin aluminium alloy.

22. A method of manufacturing an electro-acoustic transducer comprising the steps of winding a coil on the stem of a stemmed pole piece, the stem projecting from a plate, mounting an at least one magnet on the plate so as to at least surround the coil, locating this assembly within a walled housing within a non-magnetic armature supporting member situated on the base of the walled housing so as to be spaced from and surrounded by the armature supporting member, inserting a quantity of thermo-setting resin into the walled housing and allowing to cure to retain the parts in their respective positions and machining the end of the stem, the top surface of the armature supporting member and the top surfaces of the walls of the housing to predetermined levels in relation to the top surface of the at least one magnet.

* * * * *